United States Patent [19]

Arita et al.

[11] Patent Number: 5,038,082

[45] Date of Patent: Aug. 6, 1991

[54] VACUUM SWITCH APPARATUS

[75] Inventors: Hiroshi Arita, Hitachi; Kouzi Suzuki, Takahagi; Hiroyuki Sugawara; Yukio Kurosawa, both of Hitachi, all of Japan

[73] Assignee: Hitachi, Ltd., Tokyo, Japan

[21] Appl. No.: 489,666

[22] Filed: Mar. 7, 1990

[30] Foreign Application Priority Data

Mar. 10, 1989 [JP] Japan ..... 1-56492

[51] Int. Cl.[5] ..... H01J 1/00

[52] U.S. Cl. ..... 315/326; 315/357; 313/146; 313/230; 313/233; 313/293; 204/DIG. 11

[58] Field of Search ..... 315/76, 150, 290, 326, 315/334, 341, 342, 344, 349, 357, 111.81; 313/103 R, 146, 230, 233, 359.1, 293, 566; 372/38, 81, 82, 85, 87, 88; 204/157.22, DIG. 3, DIG. 11; 156/DIG. 80, DIG. 109; 75/10.13, 398

[56] References Cited

U.S. PATENT DOCUMENTS 3,458,758 7/1969 Fraser et al. ..... 315/102
4,668,896 5/1987 Byron et al. ..... 315/330

FOREIGN PATENT DOCUMENTS 2111121 9/1971 Fed. Rep. of Germany .
0134517 8/1984 Japan .
2065962 7/1981 United Kingdom .

OTHER PUBLICATIONS

Efremov, A. M. et al., "Coaxial Injection Thyratron", *Instruments and Experimental Techniques*, vol. 29, No. 4, part 1, Jul.-Aug. 1986, pp. 859-861, New York, U.S.

Menown, H. et al., "Thyratrons für Impulslaser", *Elektronik* vol. 28, No. 8, Apr. 19, 1979, pp. 68-70.

*Primary Examiner*—David Mis

*Attorney, Agent, or Firm*—Antonelli, Terry, Stout & Kraus

[57] ABSTRACT

A vacuum switch apparatus has an electrically insulating vacuum enclosure which is evacuated to a vacuum degree of $2\times10^{-2}$ Torr or less. One set of anode and cathode electrodes is arranged in the vacuum enclosure, having capacity which permits the flow of a discharge current of at least 1 KA therebetween and being operable to switch the discharge current at least $10^6$ shots. A high voltage power supply applies a high voltage of at least 20 KV across the anode and cathode electrodes. An electron beam irradiation unit irradiates an electron beam on the anode electrode through the cathode electrode. A control electrode is arranged between the beam irradiation unit and the cathode electrode, for controlling passage and interception of the electron beam. A control voltage power supply applies a control voltage to the control electrode. An electromagnetic coil is arranged at least exteriorly of the vacuum enclosure, for generating electromagnetic force which prevents the electron beam, emitted from the electron beam irradiation unit and reaching the anode electrode through the control and cathode electrodes, from being scattered.

15 Claims, 7 Drawing Sheets

TURN-ON MECHANISM

VACUUM SWITCH APPARATUS

BACKGROUND OF THE INVENTION

The present invention relates to a vacuum switch especially suitable for high voltage operation and high repetition rate switching.

In recent years, development of high output lasers has been undertaken domestically and abroad and such lasers, including an excimer laser, a copper vapor laser, a TEMA-CO2 laser and a pulse driven CO2 laser, require a very high level of pulsed electrical input power of about several tens of GW within a period of time of several hundreds of ns. Typically, the laser is utilized for isotope separation of uranium atoms, photo-exciting chemical reaction and fine working of semiconductors. A hot-cathode gas-filled thyratron as shown in FIG. 10 is used with the laser as a switching device.

For example, the thyratron includes a gas-filled discharge tube in which an anode electrode 3, a cathode electrode 5 adapted to emit thermions and a grid electrode 6 are provided. When a positive voltage pulse is applied to the grid electrode 6 in order to change the potential at the grid electrode 6 from negative to positive, an glow discharge is initiated between the cathode and anode electrodes. With the thyratron activated, electric charge in a capacitor 18 is supplied to a laser discharge tube 20. The thyratron further includes a resistor 19, a heater 8 and a charging unit 22.

When used with a copper vapor laser for uranium isotope separation, the thyratron is required to be switched at several KHz. In operation of the thyratron, with the grid electrode 6 maintained at positive potential, thermions emitted from the cathode electrode 5 are attracted to the grid and anode electrodes 6 and 3 while colliding with hydrogen gas atoms, causing them to be ionized positively. The thus produced hydrogen ions (hereinafter referred to as plasma) cause partial discharge between the grid and cathode electrodes 6 and 5 and sympathetically with this partial discharge, partial discharge takes place also between the grid and anode electrodes 6 and 3, giving rise to ultimate glow discharge.

With the grid electrode applied with negative potential, the emission of thermions from the cathode electrode 2 is prevented and the plasma diffuses while colliding with the remaining hydrogen gas. This degrades the diffusion of the plasma. Consequently, plasma remains in the discharge space between the grid electrode 6 and each of the anode and cathode electrodes and hence insulation recovery is degraded, thus increasing the intervening time which precedes the next turn-on operation. Therefore, the conventional switch is disadvantageous in that it can not be used at high voltages and that it can not be switched at high repetition rates. The conventional switch also suffers from insufficient breakdown voltage in the event that the gas filled in the interior of the switch, such as hydrogen, is deteriorated. In addition, surge voltage concomitant with discharge is drawn to the grid electrode and the thyratron drive power supply is sometimes damaged.

To solve the above problems, JP-A-59-134517 proposes an arrangement as shown in FIG. 11 in which an electron beam is used in place of the grid electrode arranged between the anode and cathode electrodes, for performing switching operation. In this proposal, an electron beam 10A is emitted into a space between rod-like electrodes 9 and 9A in order that a gas such as argon gas for discharge control is ionized to initiate discharge. In this case, the electron beam is scattered by the discharge control gas filled in the space and disadvantageously, the discharge control becomes difficult to achieve. Further, because of the use of the gas for discharge control, the plasma diffusion is degraded in high repetition rate switching to cause insufficient breakdown voltage as in the case of the thyratron.

SUMMARY OF THE INVENTION

An object of the present invention is to provide a vacuum switch which performs high repetition rate switching under a high voltage condition.

According to the invention, the above object can be accomplished by arranging at least one set of anode and cathode electrodes and an electron beam irradiation unit in a vacuum enclosure of a vacuum switch.

When turning on the vacuum switch, the anode electrode is heated by an electron beam. Metal vapor particles are discharged from the surface of the heated anode electrode and irradiated with the electron beam so as to be ionized to form a plasma, whereby electrons and positive ions are attracted to the anode and cathode electrodes, respectively, while colliding with each other to render the switch conductive, thereby starting the switch.

When turning off the switch, the electron beam irradiation is stopped so that the generation of plasma in the space between the anode and cathode electrodes is stopped at the zero point of the discharge current flowing through the main circuit. Because of the vacuum environment surrounding the plasma region, the residual electric charge diffuses instantaneously and insulation between the anode and cathode electrodes recovers rapidly.

Accordingly, since in the vacuum switch of the present invention, vacuum prevails in the space between the anode and cathode electrodes before discharging, the electron beam is not scattered and is easy to control and metal vapor particles between the two electrodes are irradiated with the electron beam to form a plasma, thus minimizing discharge jitter. After initiation of discharge, the plasma diffuses into the vacuum environment to insure rapid recovery of insulation between the anode and cathode electrodes and provide an excellent breakdown voltage characteristic, thus increasing the number of high repetition rate switching operations under high voltage condition.

DESCRIPTION OF THE PREFERRED EMBODIMENTS

Figure 1:
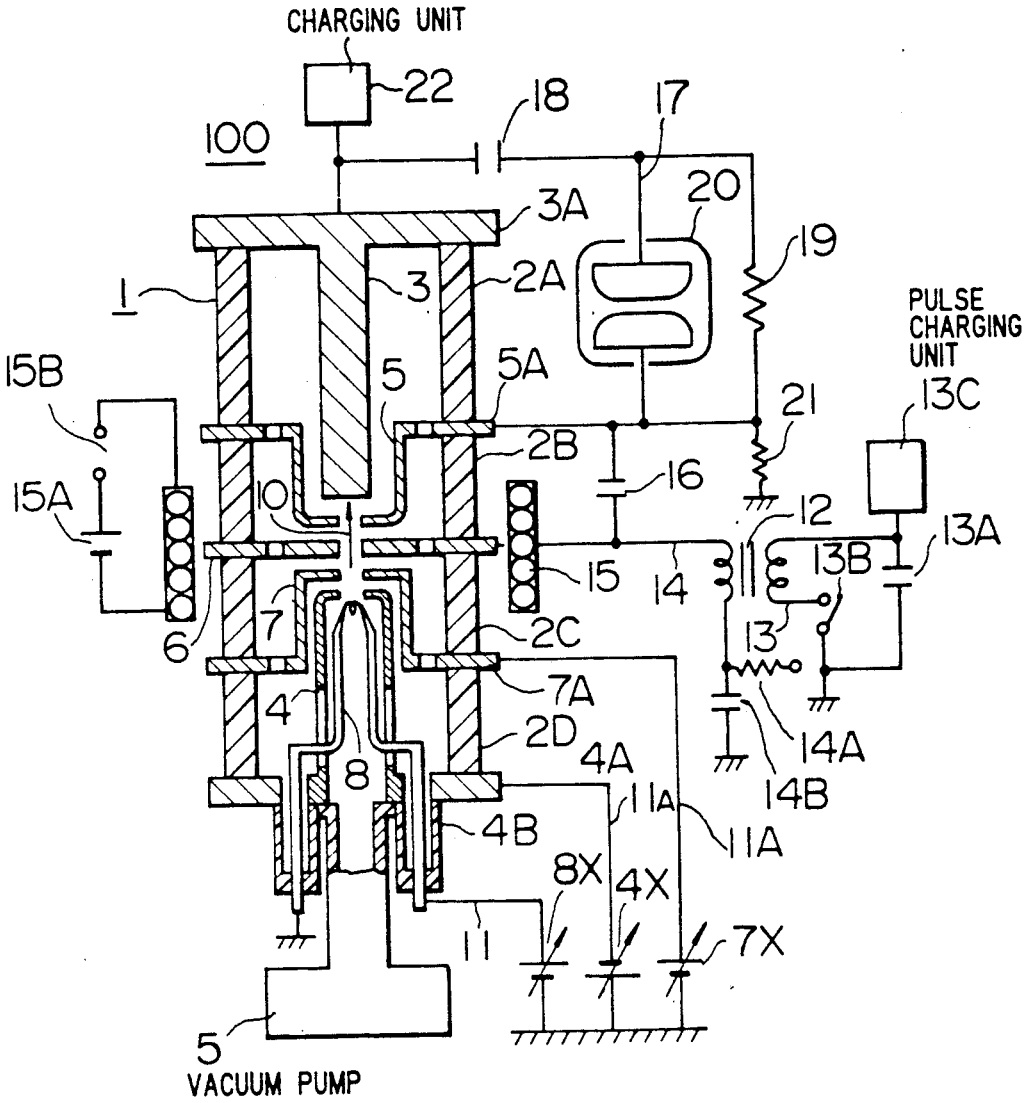
FIG. 1 is a diagram showing the construction of a vacuum switch according to a first embodiment of the invention.
Figure 2:
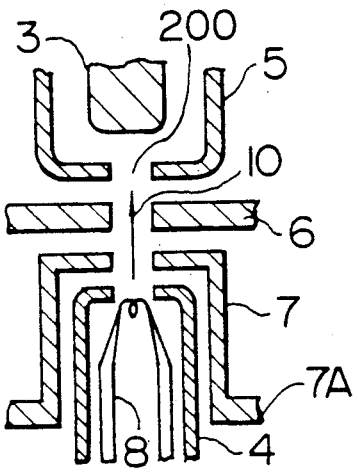
FIG. 2 is a fragmentary enlarged view illustrating the electrodes and neighboring portion of the FIG. 1 vacuum switch.
Figure 3A:
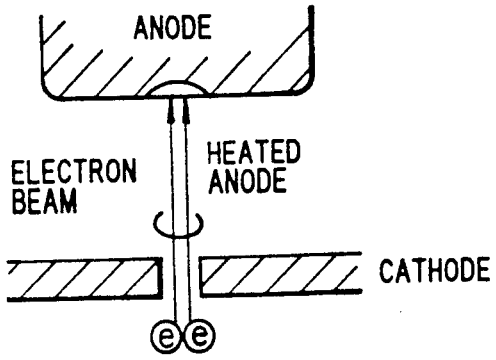
FIG. 3A-3H are diagrams useful to explain the turn on/off operation of the FIG. 1 vacuum switch.
Figure 3B:
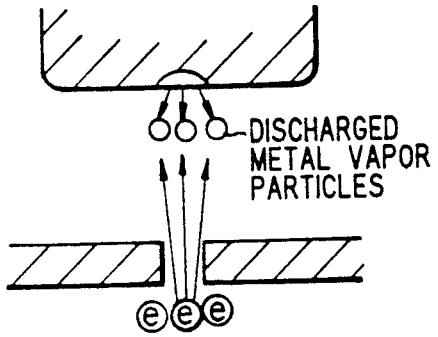
Figure 3C:
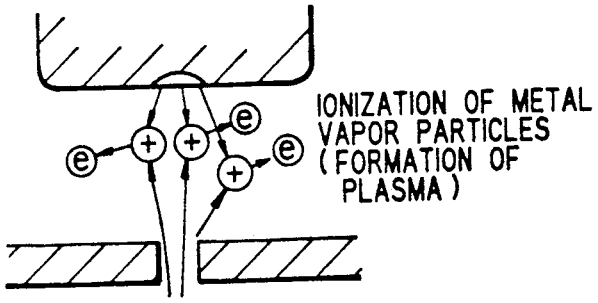
Figure 3D:
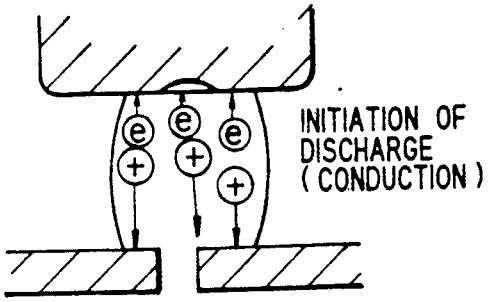
Figure 3E:
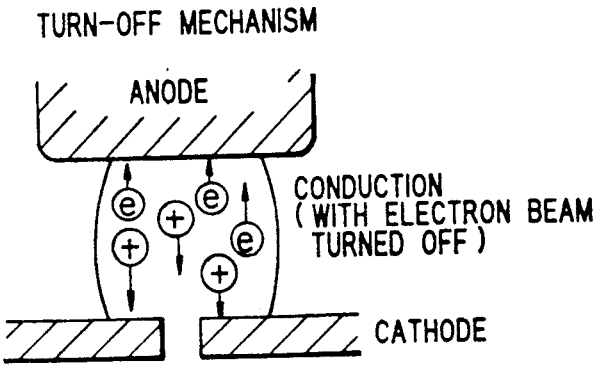
Figure 3F:
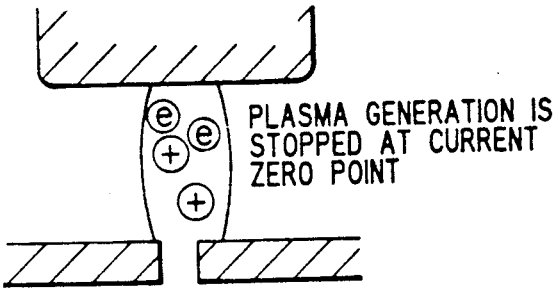
Figure 3G:
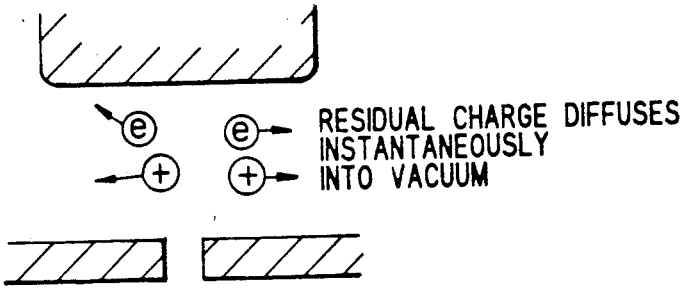
Figure 3H:
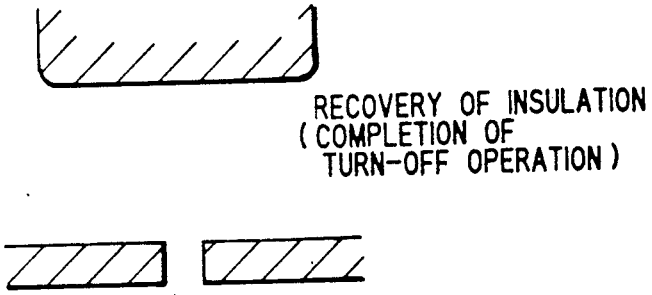

Referring now to FIGS. 1 and 2, a vacuum switch apparatus according to a first embodiment of the invention will be described. Generally designated at reference numeral 100 in FIG. 1 is a vacuum switch having the following construction.

The vacuum switch 100 has a vacuum enclosure 1 comprised of four stacked insulating cylinders 2A to 2D, flanges 3A and 4A respectively connected to the outer ends of the insulating cylinders 2A and 2D, and an insulating member 4B connected to the outer end of the flange 4A. Connected to the insulating member 4B is a vacuum pump 5. The interior of the vacuum enclosure 1 is normally evacuated by means of the vacuum pump 5 and maintained at vacuum. The degree of the vacuum is required to define a high vacuum condition of a vacuum value which is higher, in terms of dielectric strength in the Paschen curve, than the minimum. For example, a high vacuum value of less than $2\times10^{-2}$ Torr (2.66 Pa) is needed. Unless the vacuum pump is normally used, the interior of the vacuum enclosure may simply be evacuated and the vacuum enclosure may be sealed airtightly for use. Arranged inside the vacuum enclosure is at least an anode electrode 3 to be described below.

The anode electrode 3 is secured to a central portion of the flange 3A and it extends toward a cathode electrode 5. The cathode electrode 5 has a flange 5A supportingly clamped by the insulating cylinders 2A and 2B. The central cathode electrode 5 merges into the flange 5A and is formed into a cup-shape which surrounds the anode electrode 3, thereby ensuring that the current conduction area is enlarged to reduce the circuit reactance. The anode and cathode electrodes 3 and 5 are made of, for example, a material of tungsten type copper alloy which is less consumed under arcing or a material of chromium type copper alloy which has a good breakdown voltage characteristic.

A control electrode 6 is supportingly clamped by the insulating cylinders 2B and 2C to oppose both of the cathode electrode 5 and an electron current draw electrode 7. The electron current draw electrode 7 has a flange 7A supportingly clamped by the insulating cylinders 2C and 2D and extends toward the control electrode 6. Arranged inside the electron current draw electrode 7 is an electron current control electrode 4. The electron current control electrode 4 merges into the flange 4A and extends toward the electron current draw electrode 7 to form a space in which a filament 8 is arranged.

The opposite ends of the filament 8 pass through through-holes formed in the flange 4A and they are supported in the insulating member 4B so as to be exposed to the outside. A beam 10 of electrons emitted from the filament 3 and directed in a direction of arrow travels through apertures 200 formed in the control electrodes 4, 7, 6 and 5 to irradiate the anode electrode 3. The filament 8 and the electrodes 3, 5, 6 and 7 are connected at least to power supplies provided externally of the vacuum enclosure.

More particularly, the electron current draw electrode 7 and electron current control electrode 4 are connected through electric wires 11A to a power supply 7X for electron current draw and a power supply 4X for electron current control, respectively, and the filament 8 is connected through an electric wire 11 to a power supply 8X for filament. The control electrode 6 is connected to one end of a secondary winding 14 of a pulse transformer 12 and a magnetic field generation coil 15 is provided to surround the insulating cylinders 2B and 2C. The magnetic field generation coil 15 is fed from a DC power supply 15A through a switch 15B.

The pulse transformer 12 includes a primary winding 13 and the secondary winding 14. Connected across the primary winding 13 are a capacitor 13A, a pulse switch 13B and a pulse charging unit 13C, with a junction between the capacitor 13A and switch 13B grounded. Used as the pulse switch 13B is an SIT (electrostatic induction type transistor). With the pulse switch 13B opened, the control electrode 6 is applied with a negative potential and with the switch 13B closed, with a positive potential. One end of the secondary winding 14 is connected to a charging resistor 14A and a negative bias capacitor 14B which is grounded. The other end of the secondary winding 14 is connected to the control electrode 6 as described previously and to a main circuit, generally designated at reference numeral 17, through a potential capacitor 16.

The main circuit 17 is connected between the anode electrode flange 3A and cathode electrode flange 5A through a capacitor 18 and a laser oscillator 20. A resistor 19 is connected in parallel with the oscillator 20 and connected to the main circuit 17, and a resistor 21 is connected at one end to a junction between the oscillator 20 and resistor 19 and at the other end grounded. A charging unit 22 is connected to both the capacitor 18 and flange 3A.

The vacuum switch 100 is turned on and off as described below.

Firstly, the filament 8 is supplied with a positive potential from the filament power supply 8X and heated to emit an electron beam 10. Radial spreading of the electron beam 10 is suppressed by means of the electron current control electrode 4 supplied with a negative potential from the electron current control power supply 4X. The electron current draw electrode power supply 7X supplies a positive potential to the electron current draw electrode 7.

To turn on the vacuum switch, the charging unit 22 charges the capacitor 18 so that a high voltage is applied across the anode and cathode electrodes 3 and 5. Then, the pulse switch 13B is closed to discharge the capacitor 13A, with the result that a discharge current flows through the primary winding 13 to induce a voltage in the secondary winding 14, thereby applying to the control electrode 6 a positive potential V as shown at (A) in FIG. 4. At that time, discharge is initiated as shown in FIG. 3.

Figure 4A:
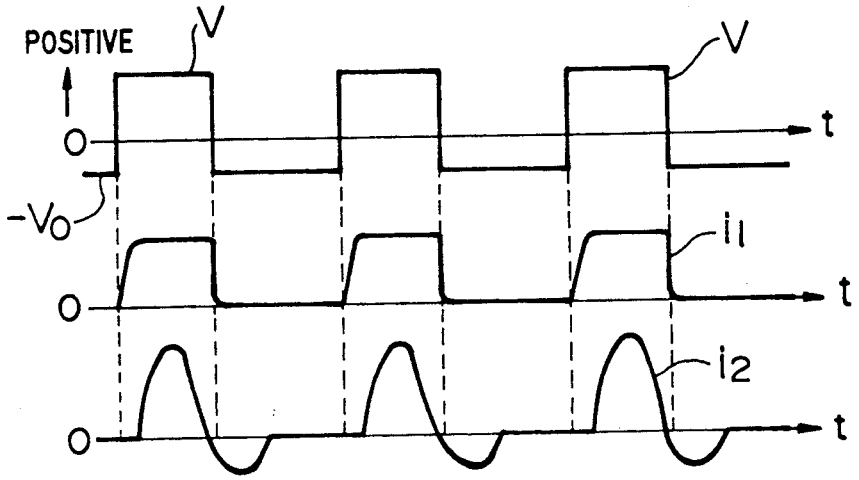
FIG. 4A and 4B are diagrams illustrating voltage applied to the control electrode of the vacuum switch, electron beam and discharge current.
Figure 4B:
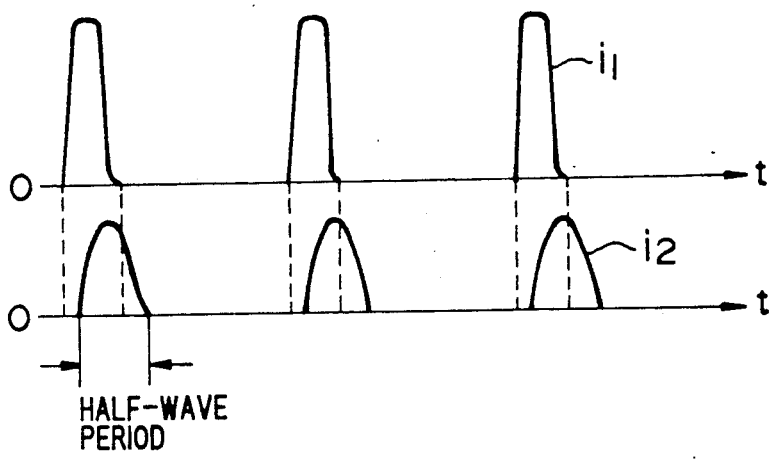

More specifically, a current $i_1$ of the electron beam 10 occurs as shown at (A) in FIG. 4 and passes through the aperture in the cathode electrode 5 to heat the anode electrode 3 (see section (A) in FIG. 3). The electron beam collides with metal vapor particles emitted from the surface of the heated anode electrode 3 (see section (B) in FIG. 3) to ionize the metal vapor particles, generating plasma (see section (C) in FIG. 3). Thus, while colliding with each other, electrons and positive ions are drawn to the anode electrode and the cathode electrode, respectively, to render the switch conductive (see section (D) in FIG. 3). At that time, the switch is started to operate with a discharging current $i_2$ as shown at section (A) in FIG. 4 flowing through the main circuit 17.

To turn off the vacuum switch, the pulse switch 13B is opened so that the control electrode 6 assumes a negative potential (−VO) as shown at (A) in FIG. 4. Consequently, the current $i_1$ of the electron beam 10 falls to zero and irradiation of the electron beam 10 is stopped (see section (E) in FIG. 3). Then, as the discharge current $i_2$ in the main circuit 17 falls to zero, the generation of plasma between the anode and cathode electrodes is stopped (see section (F) in FIG. 3). Because of the plasma region being surrounded by the vacuum environment, the residual electric charge diffuses instantaneously (see section (G) in FIG. 3) and electrical insulation between the anode and cathode electrodes recovers (see section (H) in FIG. 3).

As described above, in the present invention, because of the vacuum environment prevailing between the anode and cathode electrodes before initiation of discharge, the electron beam 10 can irradiate the anode electrode surface rapidly without being scattered to generate metal vapor particles which in turn are ionized to form a plasma. Consequently, discharge can be initiated rapidly through the main circuit 17, thereby minimizing discharge jitter. After discharge, the metal vapor particles and plasma rapidly diffuse from the discharge space into the vacuum environment, thus expediting rapid recovery of electrical insulation and rapid initiation of the next discharge. Accordingly, the vacuum switch of the present invention permits a great number of switching operations at a high repetition rate within a short period of time.

More specifically, by controlling the electron beam irradiation time such that, as shown at (B) in FIG. 4, the electron beam 10 is irradiated during an interval of times which is slightly shorter than a half-wave period of the discharge current $i_2$ in the main circuit 17 to permit early occurrence of the zero point of discharge current $i_2$ at which the discharge current is intercepted, a high repetition rate switching operation can be ensured.

Further the arc voltage for discharge between the anode and cathode electrodes 3 and 5 in a vacuum is far smaller as compared to that for discharge in a gas atmosphere and therefore the amount of energy drawn to the electrodes, that is, the product of current and arc voltage, can be small. In addition, the metal used for the anode and cathode electrodes 3 and 5, for example, tungsten/copper alloy, or chromium/copper alloy is less consumed and effective to prolong the life. For the above reasons, the number of switching operations can further be increased.

Figure 10:
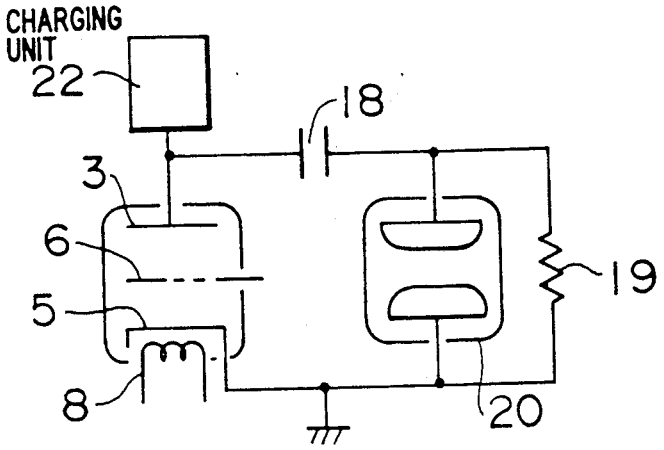
FIG. 10 PRIOR ART
FIGS. 10 and 11 are diagrams showing prior art vacuum switches.
Figure 11:
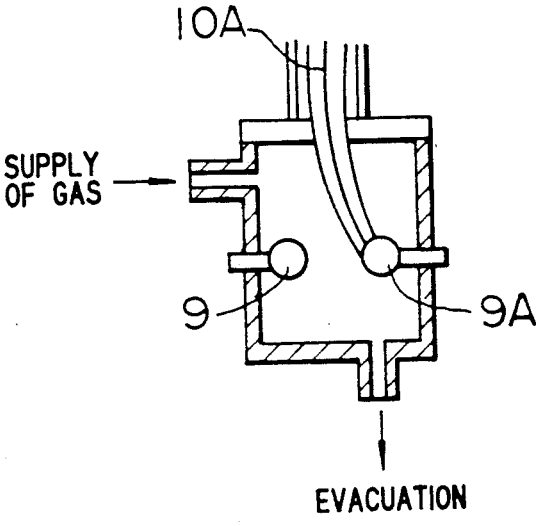
FIG. 11 PRIOR ART

In this respect, experiments conducted by the present inventors show that when in the conventional thyratron illustrated in FIG. 10, a voltage of less than 20 KV was applied across the anode and cathode electrodes to cause the flow of a discharge current of less than 1 KA therebetween, switching was effected only at $10^6$ or less shots of discharge current. Contrary to this, when using the vacuum switch of the present invention, a rated voltage of more than 20 KV was applied across the anode and cathode electrodes 3 and 5 to cause the flow of a discharge current of more than 1 KA therebetween, switching could be effected at $10^6$ or more shots of discharge current. Experimentally, a switching operation was also carried out at the rated voltage and the maximum value of discharge current. The results showed that when a rated voltage of 30 KV was applied across the anode and cathode electrodes and the flow of a discharge current of 10 DA was caused therebetween, the discharge current could be switched at $10^8$ shots according to the invention.

It should also be noted that in the foregoing embodiment, the magnetic field generation coil 15 is used to generate an axial magnetic field by which the electron beam 10 can be condensed axially for irradiation on the anode electrode without being scattered. This leads to efficient use of the electron beam 10 which improves the size of the filament 8 per se and the power supplied 4X, 7X and 8X.

In the foregoing embodiment, current is normally passed through the magnetic field generation coil 15. But in an alternative, the switch 15B may be turned on/off in synchronism with turn on/off of the pulse switch 13B. For example, the switch 15B may be opened in synchronism with opening of the pulse switch 13B to stop the flow of current in the magnetic field generation coil 15, thereby suppressing power consumption. Conversely, if the switch 15B is closed in synchronism with closure of the pulse switch 13B to permit the flow of current in the coil 15 on condition that current loss in the coil 15 is constant, the maximum permissible current can be made greater in the case of the pulsed or intermittent flow of applied current than in the case of the constant flow of current. Thus, by passing a large amount of current intermittently through the coil, the intensity of the induced magnetic field can be increased to thereby increase electron density of the electron beam 10, thus contributing to stabilization of the high repetition rate discharge.

Referring to FIGS. 5 to 9, vacuum switches according to second to sixth embodiments of the invention will now be described.

Figure 5:
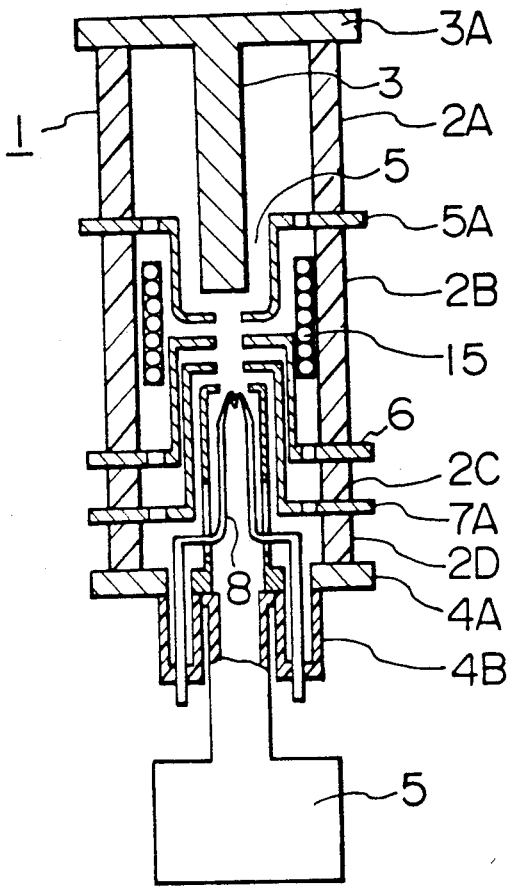
FIGS. 5 to 8 are diagrams illustrating vacuum switches according to second to fifth embodiments of the invention.

FIG. 5 shows a vacuum switch according to the second embodiment of the invention wherein a magnetic field generation coil 15 is arranged in a vacuum enclosure. Advantageously, since in this second embodiment the magnetic field density is strengthened on the center axis, the density of beam current can be increased to further improve stability of discharge control.

Figure 6:
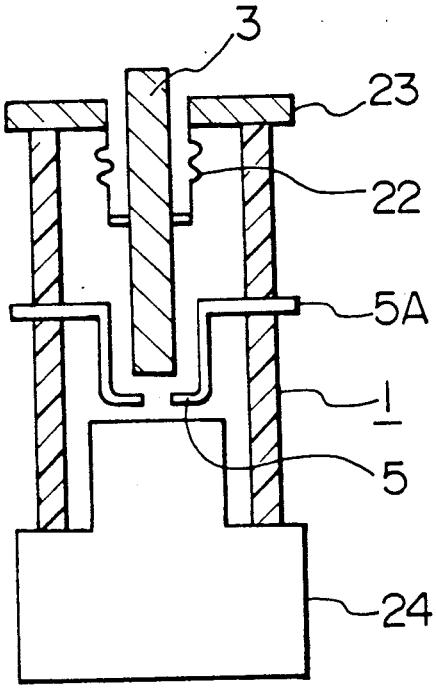

FIG. 6 shows a vacuum switch according to the third embodiment of the invention. In this third embodiment, an anode electrode 3 is attached to a flange 23 through the medium of a bellows 60 to make variable the length of a gap between the anode electrode 3 and a cathode electrode 5. With this embodiment, the breakdown voltage characteristic can be improved to about 15 KV/mm. With the gap length increased, when the amount of the electron beam supplied from an electron beam source 24 is increased, stability of discharge can be increased. In accordance with this embodiment, a vacuum switch of 100 KV class can be provided.

Figure 7:
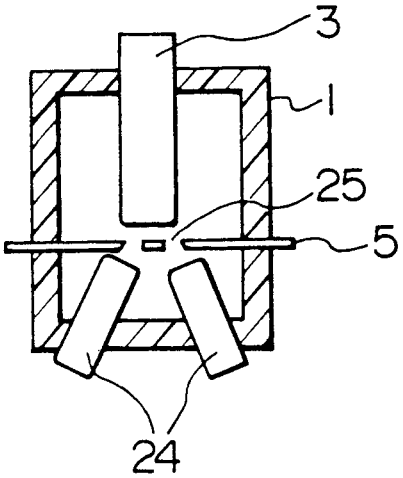

FIG. 7 shows a vacuum switch according to a fourth embodiment of the invention wherein there are provided a plurality of electron beam sources 24 and a plurality of apertures 25 so formed in a cathode electrode 5 as to oppose an anode electrode 3. In this fourth embodiment, electron beams are emitted alternately from different sources so that consumption of the anode electrode 3 may be mitigated to prolong the life of the vacuum switch.

Figure 8:
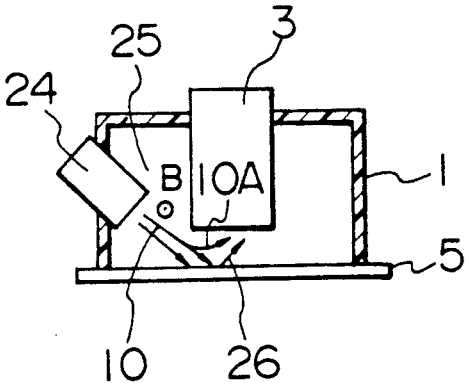

FIG. 8 shows a vacuum switch according to a fifth embodiment of the invention wherein plasma generation can be amplified by secondary electrons. In accordance with this fifth embodiment, an electron beam 10 emitted from an electron beam source 24 is deflected from the emission direction vertically to the sheet of the drawing to bombard the surface of an anode electrode 3 and vaporize the same. On the other hand, part of electrons of the electron beam failing to be deflected will bombard the surface of a cathode electrode 5 and generate secondary electrons 26. The thus generated secondary electrons collide with metal vapor particles to amplify generation of plasma. It is to be noted that in FIG. 8, the electron beam source 24 is attached to a vacuum enclosure 1 above the cathode electrode 5 and the electron beam is irradiated obliquely on the anode electrode.

Figure 9:
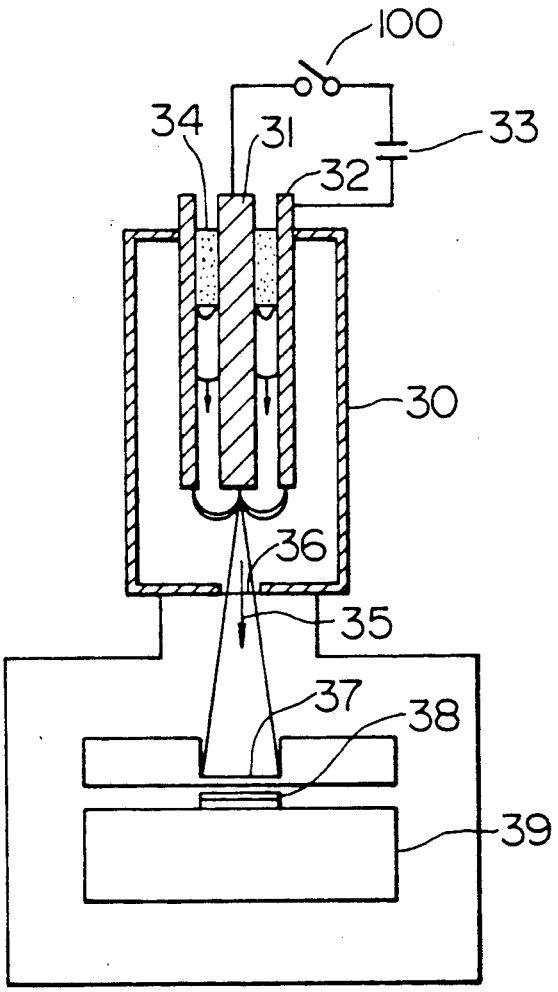
FIG. 9 is a diagram illustrating the construction of a vacuum switch as applied to a soft X-ray apparatus according to a sixth embodiment of the invention.

While in any of the foregoing embodiments the vacuum switch has been described as applied to a laser apparatus, the vacuum switch may be applied to a soft X-ray source of plasma focus type as shown in FIG. 9 according to a sixth embodiment of the invention.

In this sixth embodiment, a rare gas (Ne, Ar, Kr and so on) fills a vacuum enclosure 30. Electric charge stored in a capacitor 33 is applied across concentric electrodes 31 and 32 through a vacuum switch 100. At that time, discharge starts along the top surface of an insulator 34 and a discharge sheath then runs downwards with the result that plasma pinches in the front of the electrode 31 and soft X-rays 35 due to the high temperature and high density plasma are generated from the electrode 31. In an application of X-ray lithography, and thus generated soft X-rays 35 transmit through a transmission window 36 and a pattern defined by a mask 37 is transferred to a silicon wafer 38. Denoted by 39 is an aligner. The soft X-ray source requires a discharge current of several hundreds of KA.

The vacuum switch of the present invention can be applied to a soft X-ray source and a neutron source which utilize a large current plasma pinch, a plasma gun for shooting a spatial lump of plasma at an initial velocity of about $10^5$ m/s, an electromagnetic accelerator for accelerating a flying object of several grams to several kilo-grams, a uranium enriching system and the like. For example, in an application to the uranium enriching system wherein a uranium metal having uranium isotopes 235 and 238 is placed in a vacuum enclosure and the uranium metal is vaporized to produce rising metal vapor particles on which a laser beam emitted from a laser oscillator is irradiated, the vacuum switch of the present invention may be used to on/off control the irradiation of the laser beam on the metal vapor particles for the sake of controlling separation of the metal into uranium isotopes 235 and 238.

According to the invention, there is provided an apparatus in which at least one set of opposing anode and cathode electrodes is arranged in the vacuum enclosure and an electron beam is irradiated on the surface of the anode electrode. With this construction, because of the vacuum environment, the electron beam can be controlled properly so that the anode electrode surface can be vaporized under the bombardment of the electron beam to produce metal vapor particles which are irradiated with the electron beam to form plasma, thereby ensuring high repetition rate control of switching and high voltage operation.

We claim:

1. A vacuum switch comprising:

at least one set of electrodes including an anode electrode and a cathode electrode arranged in a vacuum enclosure; and an electron beam irradiation unit, arranged in said vacuum enclosure, for selectively irradiating an electron beam on said anode electrode to cause a discharge between said anode electrode and said cathode electrode.

2. A vacuum switch comprising:

an anode electrode and a cathode electrode arranged in a vacuum enclosure;

an electron beam irradiation unit for selectively irradiating an electron beam on said anode electrode, to cause a discharge between said anode electrode and said cathode electrode, said cathode electrode being arranged between said anode electrode and said electron beam irradiation unit; and at least one aperture formed in said cathode electrode and through which the electron beam can pass.

3. A vacuum switch comprising:

at least one set of electrodes including an anode electrode and a cathode electrode arranged in a vacuum enclosure;

an electron beam irradiation unit for irradiating an electron beam on said anode electrode to cause a discharge between said anode electrode and said cathode electrode; and means for applying a rated voltage of at least 20 KV across said anode and cathode electrodes, said anode and cathode electrodes having a capacity which permits the flow of a discharge current of at least $1000\sqrt[3]{V}$ between said two electrodes and means for controlling said electron beam irradiation unit to cause said discharge current to be switched at least $10^6$ shots.

4. A vacuum switch comprising:

at least one set of electrodes including an anode electrode and a cathode electrode arranged in a vacuum enclosure;

an electron beam irradiation unit for selectively irradiating an electron beam on said anode electrode to cause a discharge between said anode electrode and said cathode electrode; and adjusting means for adjusting the length of a gap between said anode and cathode electrodes.

5. A vacuum switch comprising:

at least one set of electrodes including an anode electrode and a cathode electrode arranged in a vacuum enclosure; and an electron beam irradiation unit for selectively irradiating an electron beam on said anode electrode to cause a discharge between said anode electrode and said cathode electrode, said anode and cathode electrodes being made of tungsten-copper alloy or chromium-copper alloy.

6. A pulse laser system comprising:

a vacuum switch having at least one set of electrodes including an anode electrode and a cathode electrode arranged in a vacuum enclosure and an electron beam unit for selectively irradiating an electron beam on said anode electrode to cause a discharge between said anode electrode and said cathode electrode; and a pulse laser oscillator connected in a circuit with said vacuum switch so as to be on/off controlled by said vacuum switch.

7. A uranium enriching system comprising:

a vacuum switch having at least one set of electrodes including an anode electrode and a cathode electrode arranged in a vacuum enclosure and an electron beam unit for selectively irradiating an electron beam on said anode electrode to cause a discharge between said anode electrode and said cathode electrode;

a pulse laser oscillator connected in a circuit with said vacuum switch so as to be on/off controlled by said vacuum switch; and means for irradiating a laser beam emitted from said pulse laser oscillator on uranium metal vapor particles of uranium isotopes 235 and 238 so as to separate these isotopes from each other.

8. A vacuum switch apparatus comprising:

at least one set of electrodes including an anode electrode and a cathode electrode arranged in a vacuum enclosure;

an electron beam irradiation unit for irradiating an electron beam on said anode electrode;

a control electrode arranged in said vacuum enclosure, for controlling on/off operation of the electron beam;

a pulse transformer having a secondary winding connected to said control electrode; and a control switch connected to a primary winding of said pulse transformer and operable to control said control electrode such that potential on said control electrode is positive or negative.

9. A method of controlling a vacuum switch apparatus having at least one set of electrodes including an anode electrode and a cathode electrode arranged in a vacuum enclosure, an electron beam irradiation unit for irradiating an electron beam on said anode electrode, a control electrode arranged in said vacuum enclosure, for controlling on/off operation of the electron beam, a pulse transformer having a secondary winding connected to said control electrode, and a control switch connected to a primary winding of said pulse transformer and operable to control said control electrode such that potential on said control electrode is positive or negative, said control method comprising the steps of:

applying voltages across said anode and cathode electrodes and to said electron beam irradiation unit;

operating said control switch to apply a positive or negative potential to said control electrode, thereby on/off controlling the irradiation of the electron beam emitted from said electron beam unit on said anode electrode.

10. A vacuum switch apparatus comprising:

at least one set of electrodes including an anode electrode and a cathode electrode arranged in a vacuum enclosure;

an electron beam irradiation unit for irradiating an electron beam on said anode electrode to cause a discharge between said anode electrode and said cathode electrode;

a magnetic field generation coil arranged interiorly of said vacuum enclosure; and a control switch connected to said magnetic field generation coil.

11. A vacuum switch apparatus comprising:

at least one set of electrodes including an anode electrode and a cathode electrode arranged in a vacuum enclosure;

an electron beam irradiation unit for irradiating an electron beam on said anode electrode to cause a discharge between said anode electrode and said cathode electrode;

a control electrode arranged in said vacuum enclosure, for controlling on/off operation of the electron beam;

a pulse transformer having a secondary winding connected to said control electrode;

a first control switch connected to a primary winding of said pulse transformer and operable to control said control electrode such that potential on said control electrode is positive or negative;

a magnetic field generation coil arranged interiorly of said vacuum enclosure; and said second switch being opened and closed in synchronism with open and close operation of said first switch.

12. A vacuum switch apparatus comprising:

an electrically insulating vacuum enclosure evacuated to a vacuum degree of $2\times10^{-2}$ Torr or less;

one set of electrodes, including an anode electrode and a cathode electrode arranged in said vacuum enclosure, having capacity which permits the flow of a discharge current of at least 1 KA between said two electrodes and operable for switching the discharge current at at least $10^6$ shots;

high voltage application means for applying a high voltage of at least 20 KV across said anode and cathode electrodes;

electron beam irradiation means for irradiating an electron beam through said cathode electrode;

a control electrode arranged between said beam irradiation means and said cathode electrode, for controlling passage and interception of the electron beam;

control voltage application means for applying a control voltage to said control electrode; and an electromagnetic coil arranged interiorly of said vacuum enclosure, for generating electromagnetic force which prevents said electron beam, emitted from said electron beam irradiation means and reaching said anode electrode through said control and cathode electrodes, from being scattered.

13. A vacuum switch apparatus comprising:

at least one set of electrodes including an anode electrode and a cathode electrode arranged in a vacuum enclosure;

an electron beam irradiation unit for irradiating an electron beam on said anode electrode to cause a discharge between said anode electrode and said cathode electrode;

a magnetic field generation coil arranged exteriorly of said vacuum enclosure; and a control switch connected to said magnetic field generation coil.

14. A vacuum switch apparatus comprising:

at least one set of electrodes including an anode electrode and a cathode electrode arranged in a vacuum enclosure;

an electron beam irradiation unit for irradiating an electron beam on said anode electrode to cause a discharge between said anode electrode and said cathode electrode;

a control electrode arranged in said vacuum enclosure, for controlling on/off operation of the electron beam;

a pulse transformer having a secondary winding connected to said control electrode;

a first control switch connected to a primary winding of said pulse transformer and operable to control said control electrode such that potential on said control electrode is positive or negative;

a magnetic field generation coil arranged exteriorly of said vacuum enclosure; and a second control switch connected to said magnetic field generation coil, said second switch being opened and closed in synchronism with open and close operation of said first switch.

15. A vacuum switch apparatus comprising:

an electrically insulating vacuum enclosure evacuated to a vacuum degree of $2\times10^{-2}$ Torr or less;

one set of electrodes, including an anode electrode and a cathode electrode arranged in said vacuum enclosure, having capacity which permits the flow of a discharge current of at least 1 KA between said two electrodes and operable for switching the discharge current at at least $10^6$ shots;

high voltage application means for applying a high voltage of at least 20 KV across said anode and cathode electrodes;

electron beam irradiation means for irradiating an electron beam through said cathode electrode;

a control electrode arranged between said beam irradiation means and said cathode electrode, for controlling passage and interception of the electron beam;

control voltage application means for applying a control voltage to said control electrode; and an electromagnetic coil arranged exteriorly of said vacuum enclosure, for generating electromagnetic force which prevent said electron beam, emitted from said electron beam irradiation means and reaching said anode electrode through said control and cathode electrodes, from being scattered.

* * * * *